US010299557B2

(12) United States Patent
Tong

(10) Patent No.: US 10,299,557 B2
(45) Date of Patent: May 28, 2019

(54) LIGHTWEIGHT CLOTH COVER SUITCASE

(71) Applicant: Joy Tong, Boca Raton, FL (US)

(72) Inventor: Joy Tong, Boca Raton, FL (US)

( * ) Notice: Subject to any disclaimer, the term of this patent is extended or adjusted under 35 U.S.C. 154(b) by 150 days.

(21) Appl. No.: 15/497,213

(22) Filed: Apr. 26, 2017

(65) Prior Publication Data

US 2018/0310683 A1 Nov. 1, 2018

(51) Int. Cl.

| | |
|---|---|
| ***A45C 13/00*** | (2006.01) |
| ***A45C 13/04*** | (2006.01) |
| ***A45C 13/06*** | (2006.01) |
| ***A45C 13/36*** | (2006.01) |
| ***A45C 5/14*** | (2006.01) |
| ***A45C 5/02*** | (2006.01) |
| ***A45C 5/03*** | (2006.01) |

(52) U.S. Cl.

CPC ..... *A45C 13/04* (2013.01); *A45C 5/02* (2013.01); *A45C 5/03* (2013.01); *A45C 5/14* (2013.01); *A45C 13/06* (2013.01); *A45C 13/36* (2013.01); *A45C 2005/035* (2013.01)

(58) Field of Classification Search

CPC .. A45C 13/04; A45C 5/02; A45C 5/03; A45C 5/14; A45C 13/06; A45C 13/36; A45C 2005/035

See application file for complete search history.

(56) References Cited

U.S. PATENT DOCUMENTS 4,784,248 A * 11/1988 Workman ..... A45C 3/00 112/419
5,400,903 A * 3/1995 Cooley ..... A45C 13/02 190/29
5,474,162 A 12/1995 Shyr et al.
5,566,798 A 10/1996 Tsai
5,634,538 A * 6/1997 Tsai ..... A45C 5/14 190/126
5,749,446 A * 5/1998 Hsieh ..... A45C 7/0022 190/103
6,109,404 A * 8/2000 Bishop ..... A45C 5/14 190/115
6,148,973 A * 11/2000 Chang ..... A45C 5/14 190/115
6,293,378 B1 * 9/2001 Lin ..... A45C 5/14 190/115
6,502,677 B1 * 1/2003 Tiramani ..... A45C 5/03 16/114.1
9,549,597 B2 * 1/2017 Meersschaert ..... A45C 5/03
2012/0006640 A1 1/2012 Santy
2012/0138403 A1 6/2012 Tong
2013/0075213 A1 * 3/2013 Chi Yueh Chen ... A45C 7/0054 190/18 A
2014/0299430 A1 * 10/2014 Tseng ..... A45C 5/02 190/107

* cited by examiner

*Primary Examiner* — Tri M Mai

(74) *Attorney, Agent, or Firm* — Pai Patent & Trademark Law Firm; Chao-Chang David Pai

(57) ABSTRACT

A lightweight cloth cover suitcase includes a cloth cover, a skeleton including a rectangular metal frame, top and bottom supporting plates respectively mounted at opposing top and bottom sides of the metal frame and adapted to support the top and bottom sides of the cloth cover, a slotted back panel adapted to support the back side of the cloth cover and a honeycomb panel mounted between the bottom supporting plate and the metal frame to enhance the mounting strength of wheel modules that are arranged at the bottom side of the cloth cover.

9 Claims, 7 Drawing Sheets

LIGHTWEIGHT CLOTH COVER SUITCASE

BACKGROUND OF THE INVENTION

(a) Field of the Invention

The present invention relates to suitcase technology and more particularly to a lightweight cloth cover suitcase, which enables the weight of the suitcase to be minimized.

(b) Description of the Prior Art

The cloth cover of a commercial cloth suitcase (nylon suitcase) is made by stitching nylon fabric into a covering comprising a body and a cover flap. The cover flap has one side thereof joined to one side of a front opening of the body. The other sides of the cover flap are openably fastened to the other sides of the front opening of the body by a zip fastener. Further, a skeleton is mounted within the cloth cover to support the cloth cover in shape. The main problem of the current skeleton techniques is that the factors of support strength and light weight are difficult to take into account. Thus, there is still room for improvement. U.S. Pat. No. 6,293,378, US20120006640 and US20120138403 teach the use of a substantially C-shaped plastic plane as a skeleton to provide support, achieving the desired lightweight effect. However, using C-shaped plastic plane as a skeleton cannot provide sufficient support against heavy impact.

Further, U.S. Pat. Nos. 5,566,798, 5,474,162 and 6,109,404 teach the use of a rectangular supporting frame with plastic corner plates on the inside of the trunk to give support. U.S. Pat. No. 5,566,798 also teaches the use of a one-piece plastic plate member to surround the top, bottom and two opposite lateral sides of the rectangular supporting frame. U.S. Pat. No. 5,474,162 teaches the use of two substantially C-shaped plastic plates at two opposite lateral sides of the rectangular supporting frame to support the opposing lateral sides and corners of the traveling bag. U.S. Pat. No. 6,109,404 also teaches the arrangement of two U-shaped plastic plates on the opposing top and bottom sides of the rectangular supporting frame to support the opposing top and bottom sides and corners of the luggage. The above-mentioned prior art skeleton designs emphasize the support of the corners, but the back support is insufficient. When clothes are received on the inside, the fabric of the back of the body of the cloth cover will be squeezed to deform and to stick out. The arrangement of a back plate on the back side can improve this problem, but how to make the backplane easier to install is another technical problem to be overcome. Further, in U.S. Pat. No. 6,109,404, the U-shaped plastic plate on the bottom side of the rectangular supporting frame to support the bottom side of the luggage is a thin sheet of plastic member that is not strong enough. If wheel sets are directly mounted at the bottom side of this U-shaped plastic plate, the wheel sets will be unstable.

SUMMARY OF THE INVENTION

The present invention has been accomplished under the circumstances in view. It is one object of the present invention to provide a lightweight cloth cover suitcase, which uses a skeleton to support a cloth cover in shape, enhancing the structural strength of the back and bottom sides of the suitcase without increasing much weight, thereby providing the effects of high structural strength and lightweight.

It is another object of the present invention to provide a lightweight cloth cover suitcase, which uses four corner plates to secure a slotted back panel in the skeleton, thereby enhancing the structural strength of the back side of the suitcase and facilitating quick installation of the slotted back panel.

It is still another object of the present invention to provide a lightweight cloth cover suitcase, which enables the mounting frames of the wheel modules to be affixed with the bottom supporting plate and honeycomb panel of the skeleton, thus simplifying the overall mounting structure and mounting operation.

Other advantages and features of the present invention will be fully understood by reference to the following specification in conjunction with the accompanying drawings, in which like reference signs denote like components of the structure.

DETAILED DESCRIPTION OF THE PREFERRED EMBODIMENTS

Referring to FIGS. 1, 2, 3 and 4, a lightweight cloth cover suitcase in accordance with the present invention is shown. As illustrated, the lightweight cloth cover suitcase comprises a cloth cover 10, a skeleton 20, a plurality of wheel modules 30 and a retractable handle module 40.

Figure 1:
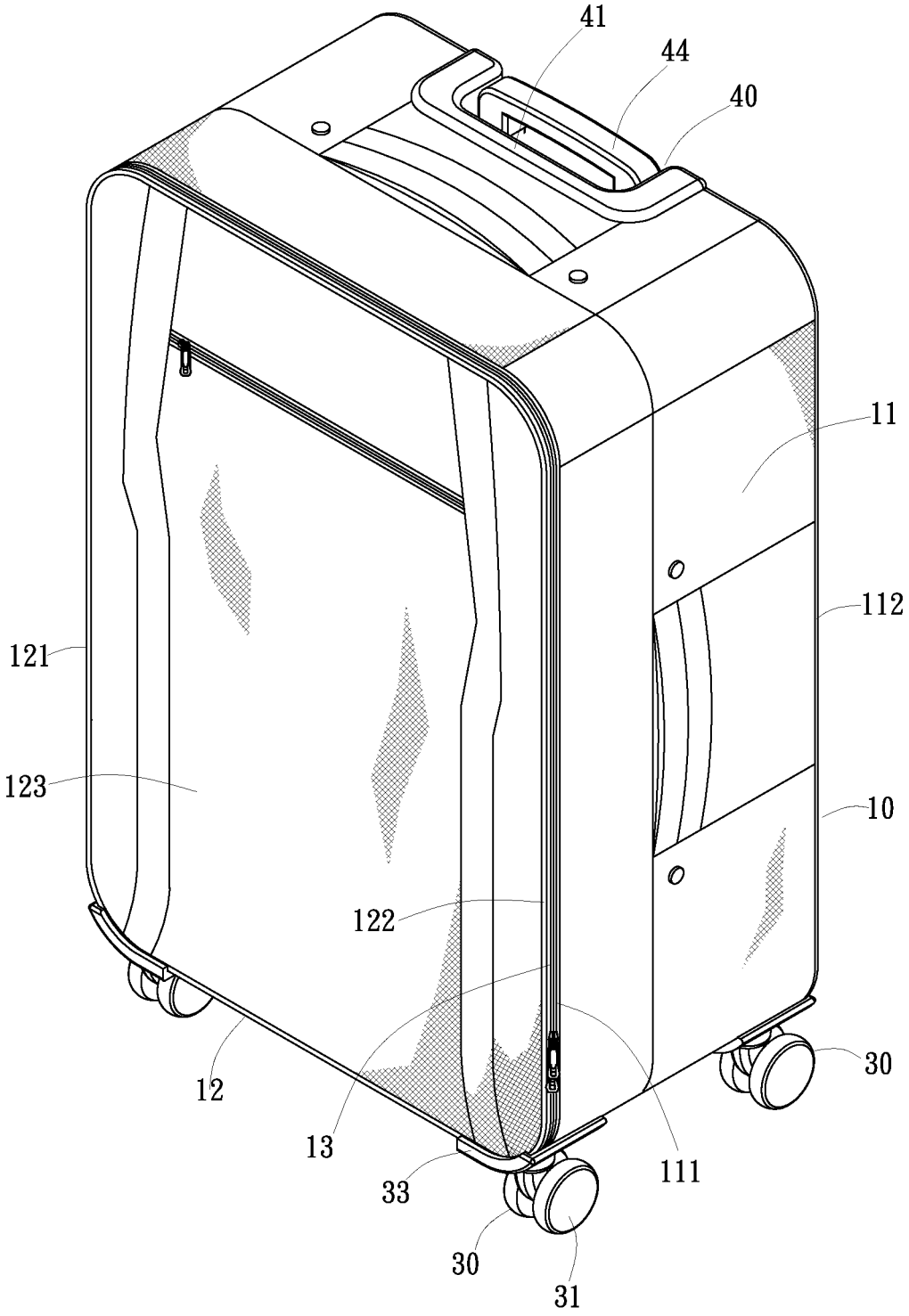
FIG. 1 is an oblique top elevational view of a lightweight cloth cover suitcase in accordance with the present invention.
Figure 2:
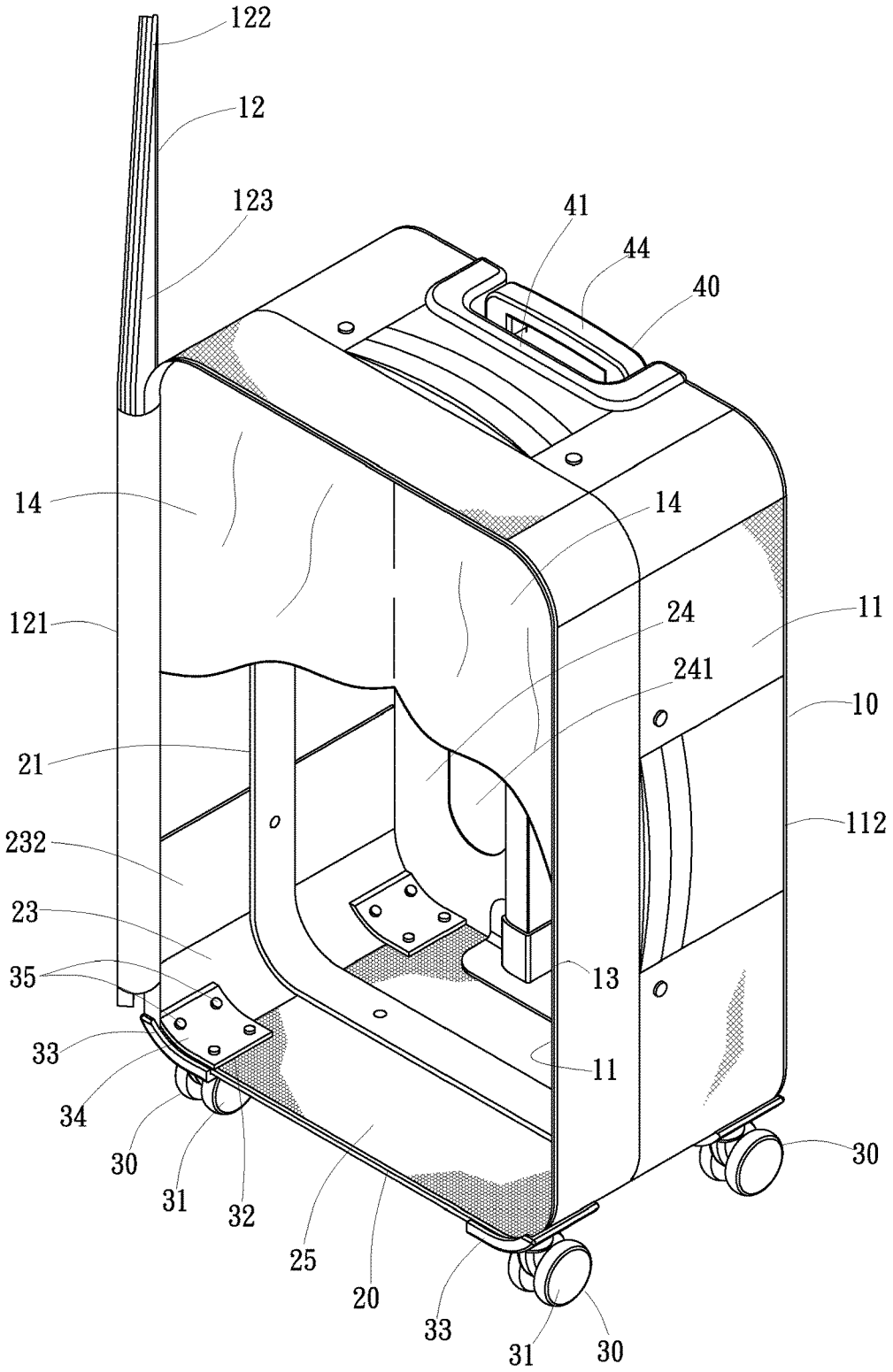
FIG. 2 is a schematic sectional elevational view of the lightweight cloth cover suitcase in accordance with the present invention.

The cloth cover 10 is made by fastening multiple pieces of fabric sheets, for example, nylon sheets with stitches, and is adapted for wrapping about the skeleton 20 to form an outer wrapping of the suitcase. In the present preferred embodiment, as illustrated in FIG. 1 and FIG. 2, the cloth cover 10 comprises a rectangular body 11 and a cover flap 12. The body 11 defines an opening 111 in a front side thereof. The cover flap 12 has one lateral side 121 thereof fixedly connected to one lateral side of the opening 111 of the body 11. The other three sides of the cover flap 12 are openably fastened to the other three sides of the opening 111 of the body 11 with a zip fastener 13. The body 11 of the cloth cover 10 comprises a rear tubular wire 112 affixed to and extended around the border of an opposing back side thereof, and a front tubular wire 122 affixed to and extended around the border of a front surface 123 of the cover flap 12.

Figure 3:
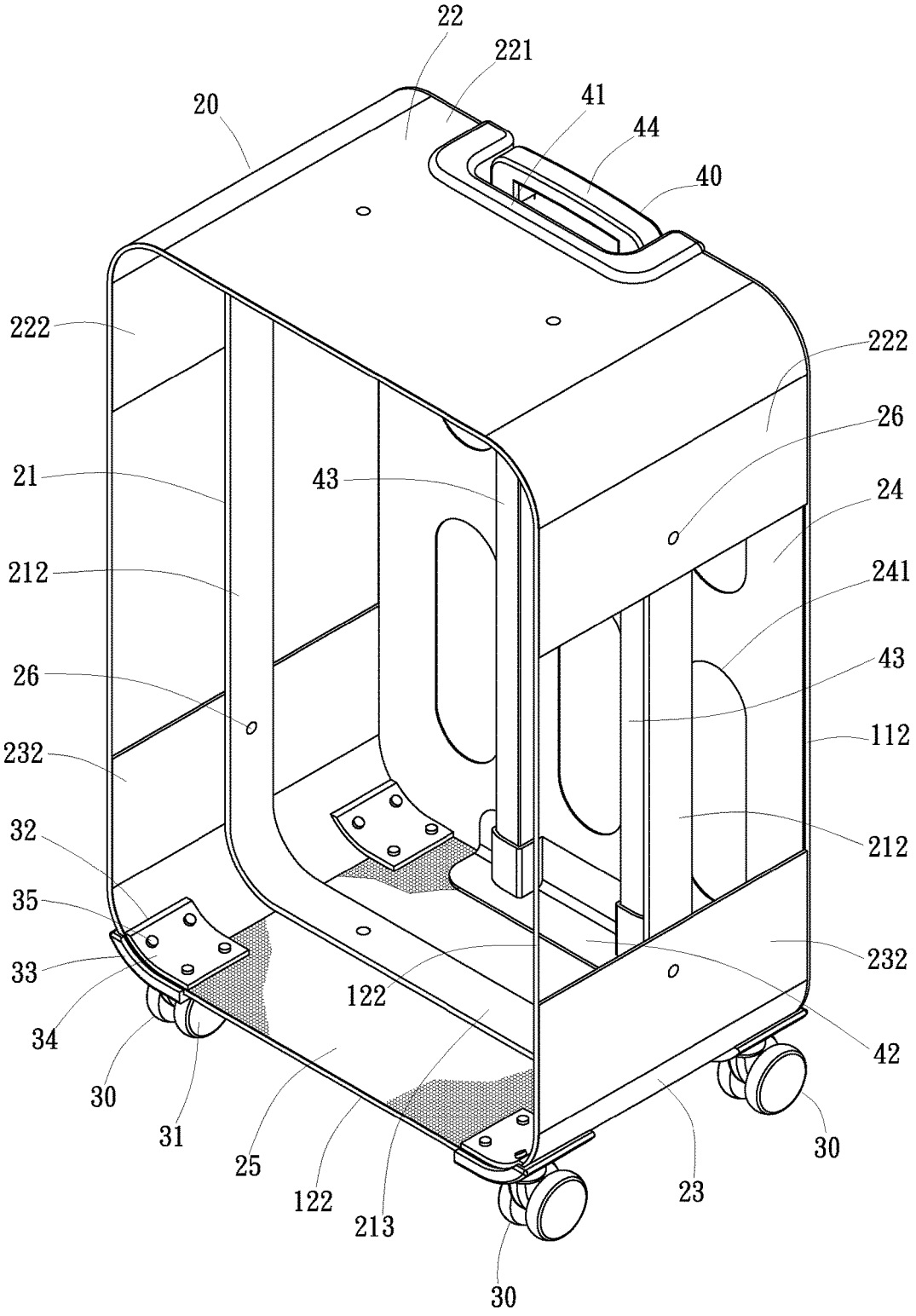
FIG. 3 is an oblique front top elevational view of the lightweight cloth cover suitcase in accordance with the present invention after removal of the cloth cover.
Figure 4:
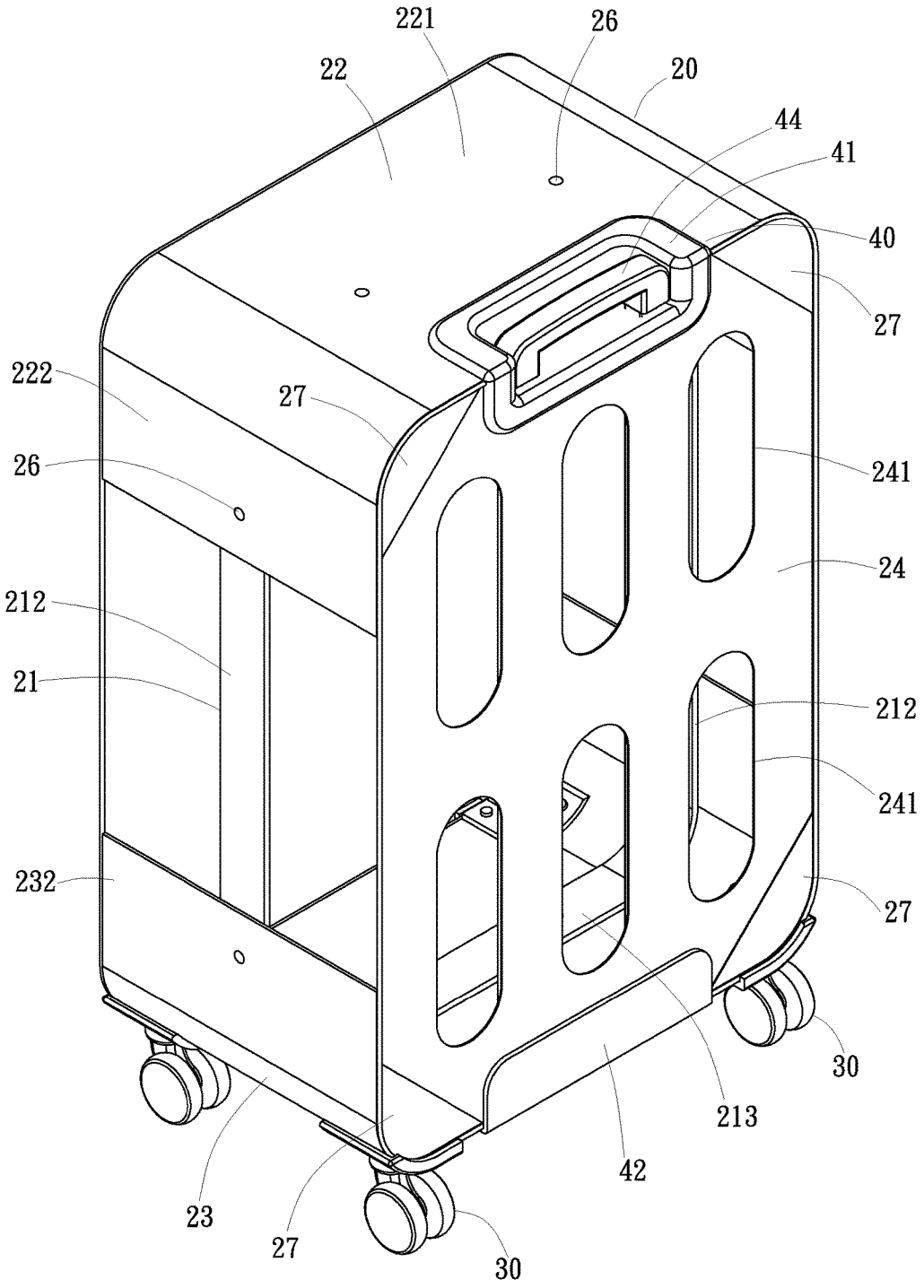
FIG. 4 is an oblique rear top elevational view of the lightweight cloth cover suitcase in accordance with the present invention after removal of the cloth cover.
Figure 5:
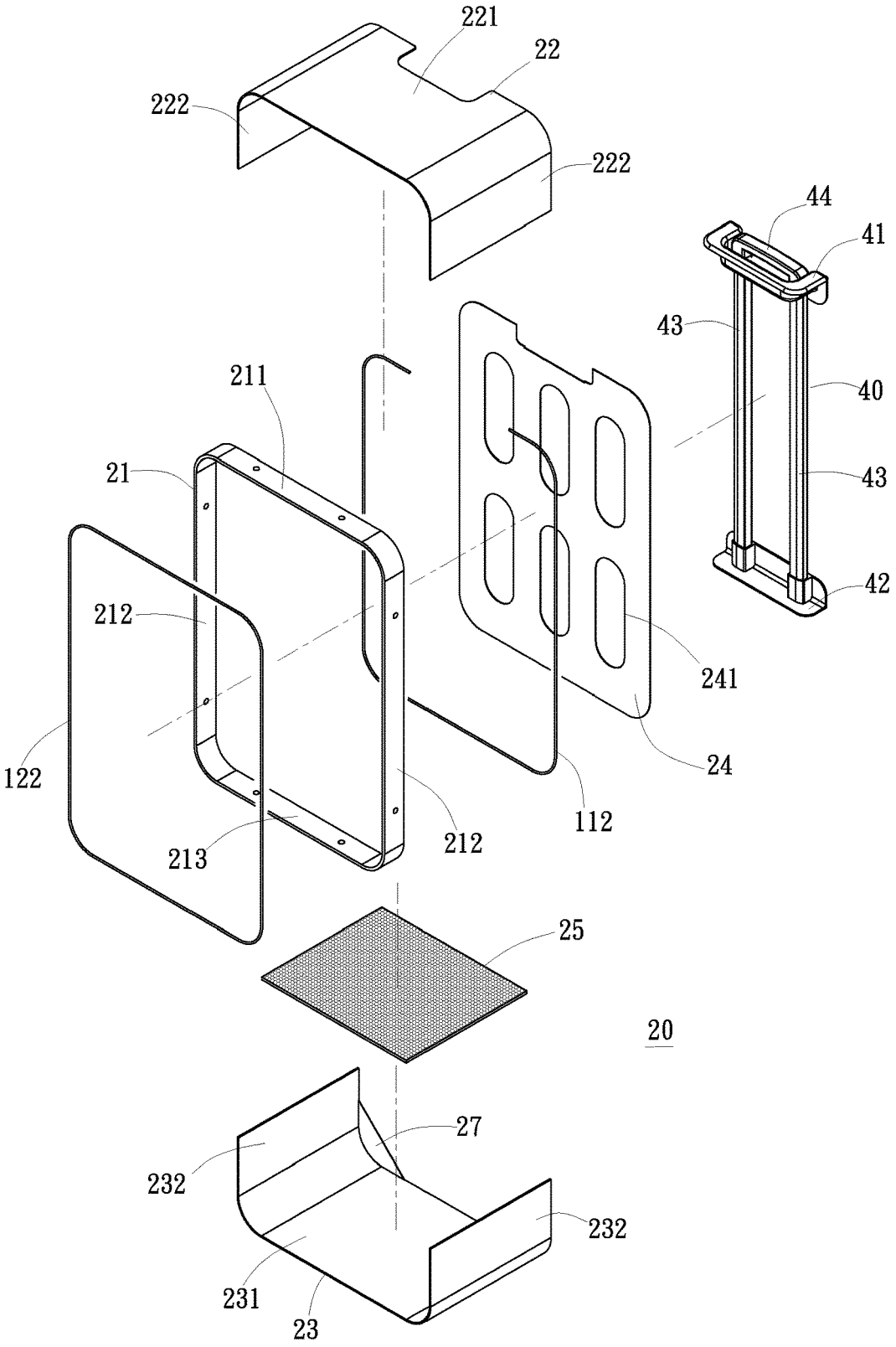
FIG. 5 is an exploded view of a part of the lightweight cloth cover suitcase in accordance with the present invention, illustrating the structural details of the skeleton.

The skeleton 20 is mounted within the body 11 of the cloth cover 10 to support the body 11 in a three-dimensional rectangular shape (see FIG. 2), and covered by an inner lining 14 of the body 11. Referring also to FIGS. 3, 4 and 5, the skeleton 20 preferably comprises a metal frame 21 that is a rectangular open frame made by bending a rectangular frame bar into shape, a top supporting plate 22 that comprises a top panel 221 fixedly mounted at a top side of a top frame bar portion 211 of the metal frame 21 (see FIG. 5) and two first lateral panels 222 respectively downwardly curved from two opposite lateral sides of the top panel 221 and respectively affixed to respective upper parts of two opposing side frame bar portions 212 of the metal frame 21 at an outer side, a bottom supporting plate 23 that comprises a bottom panel 231 fixedly mounted at a bottom side of a bottom frame bar portion 213 of the metal frame 21 and two second lateral panels 232 respectively upwardly curved from two opposite lateral sides of the bottom panel 231 and respectively affixed to respective lower parts of the two opposing side frame bar portions 212 of the metal frame 21 at an outer side, a slotted back panel 24 that is a rectangular panel affixed to a back side of the body 11 and has a plurality of openings 241 to reduce the weight, and a honeycomb panel 25 that is a rectangular plastic hollow board having multiple honeycomb holes defined therein and fixedly mounted between a top surface of the bottom panel 231 of the bottom supporting plate 23 and a bottom surface of the bottom frame bar portion 213 to reinforce the structural strength of the bottom supporting plate 23. Further, the hollow design of the honeycomb panel 25 prevents overweight. The two first lateral panels 222 may be integrally formed with the top panel 221 of the top supporting plate 22. Similarly, the two second lateral panels 232 may be integrally formed with the bottom panel 231 of the bottom supporting place 23.

The wheel modules 30 are respectively mounted at a bottom side of the body 11 of the cloth cover 10 to facilitate movement. In the preferred embodiment of the present invention as illustrated in FIG. 3 and FIG. 4, there are four wheel modules 30 mounted at the bottom side of the body 11 of the cloth cover 10, each wheel module 30 comprises at least, for example, two rollers 31, and a mounting frame 32 fixedly mounted between the bottom supporting plate 23 and the honeycomb panel 25.

The retractable handle module 40 is adapted for gripping by the user so that the user can drag the suitcase conveniently with less effort. As illustrated in FIG. 3 and FIG. 4, the retractable handle module 40 comprises a top mounting frame 41 fixedly mounted at a rear side of the top panel 221 of the top supporting plate 22 (abutting the slotted back panel 24), a bottom mounting frame 42 fixedly mounted at a rear side of the bottom panel 231 of the bottom supporting plate 23 (abutting the slotted back panel 24), two vertically extending retractable bars 43 with respective bottom ends thereof respectively affixed to the bottom mounting frame 42 and respective opposing top ends thereof inserted through the top mounting frame 41 to protrude over the top surface of the top mounting frame 41, and a grip 44 fixedly connected between the top ends of the retractable bars 43.

Figure 6:
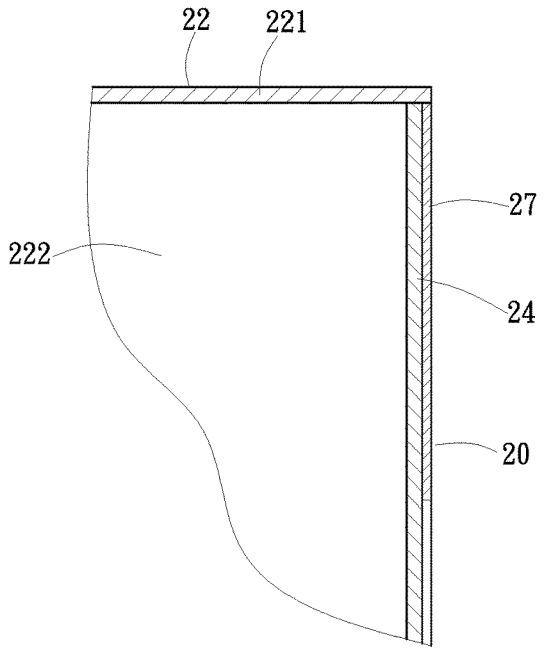
FIG. 6 is a schematic sectional view of a part of the present invention, illustrating the arrangement of the corner plate in the top supporting plate.

Further, the top supporting plate 22, the bottom supporting plate 23 and the slotted back panel 24 are preferably made from polyethylene (PE). The top supporting plate 22 and the bottom supporting plate 23 are respectively affixed to the metal frame 21 with rivets 26 or screws. Further, as illustrated in FIG. 4 and FIG. 6, the slotted back panel 24 is fastened to the back side of the body 11 with four corner plates 27. These corner plates 27 may be ethylene vinyl acetate (EVA) copolymer foam boards respectively mounted in respective first inner corners between the top panel 221 and first lateral panels 222 of the top supporting plate 22 and respective second inner corners between the bottom panel 231 and second lateral panels 232 of the bottom supporting plate 23. Thus, the slotted back panel 24 is fastened to the respective front surfaces of the corner plates 27 that face toward the metal frame 21.

Figure 7:
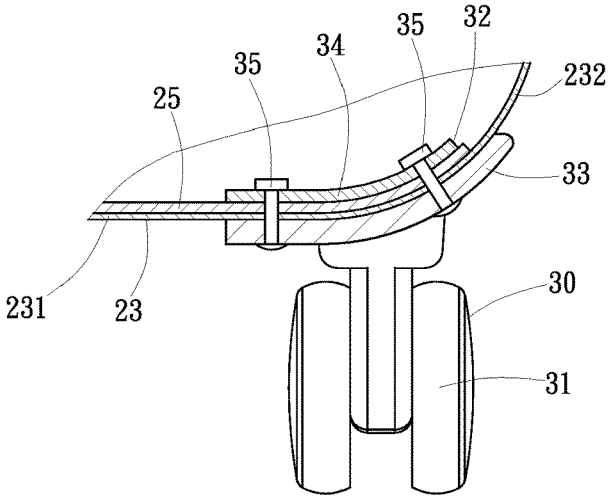
FIG. 7 is a schematic sectional view of a part of the present invention, illustrating the mounting arrangement of one wheel module.

The stacked arrangement of the bottom supporting plate 23 and honeycomb panel 25 of the skeleton 20 provide a supporting base for the wheel modules 30 to prevent excessive deformation. In installation, the mounting frames 32 of the wheel modules 30, the bottom supporting plate 23 and the honeycomb panel 25 are fixedly fastened together so that no other fastening measures will be necessary to secure the bottom supporting plate 23 and the honeycomb panel 25 together. Referring also to FIG. 2 and FIG. 7, the mounting frame 32 of each wheel module 30 comprises a wheel holder 33 closely attached to the bottom surface of the body 11 of the cloth cover 10, a packing plate 34 closely attached to the top surface of the honeycomb panel 25, and a plurality of rivets 35 or screws inserted through the packing plate 34, the honeycomb panel 25, the bottom panel 231 of the bottom supporting plate 23, the wheel holder 33 and the bottom side of the body 11 to fasten the wheel module 30, the bottom supporting plate 23 and the honeycomb panel 25 together.

Figure 8:
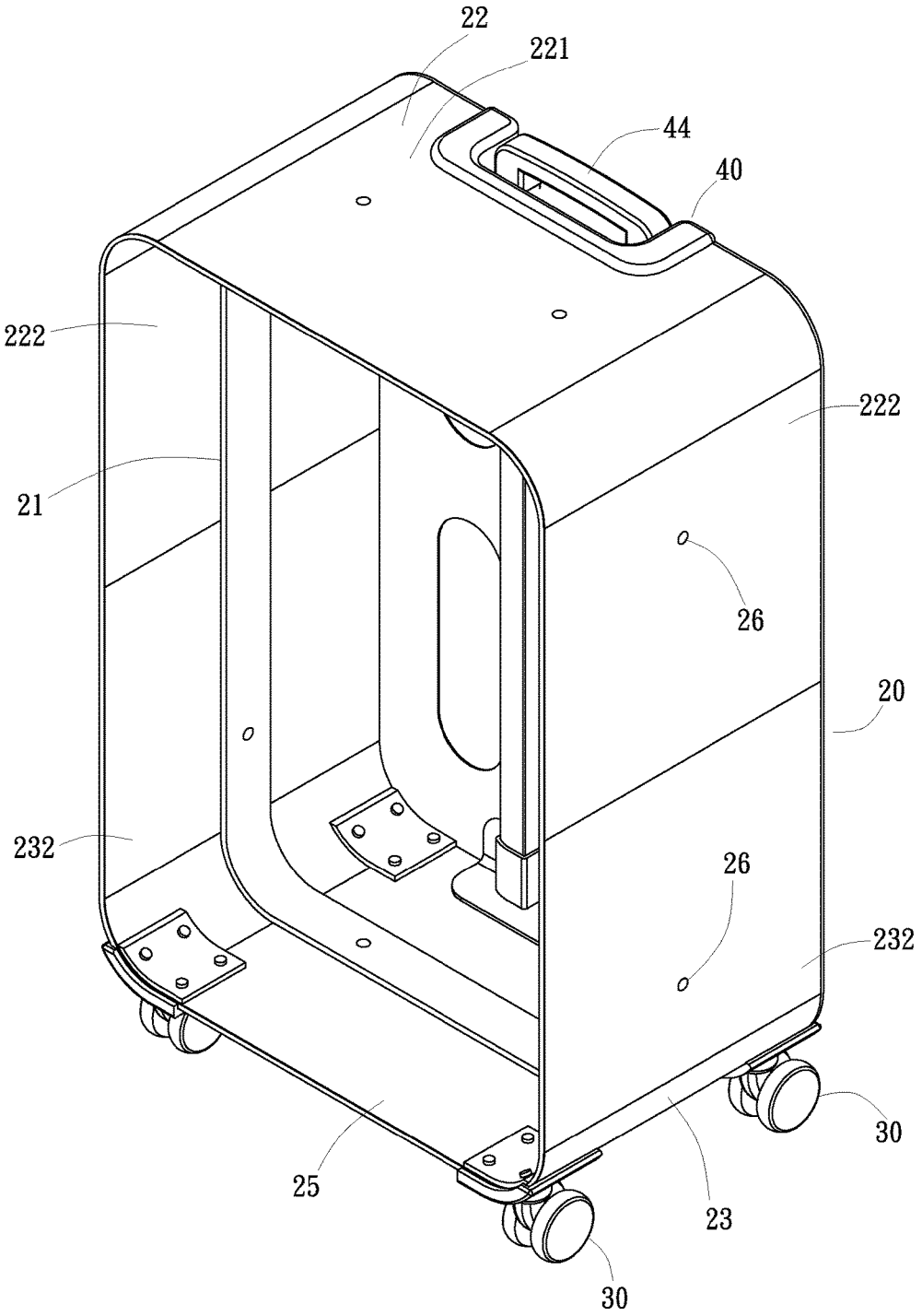
FIG. 8 is an oblique front top elevational view of a part of the present invention, illustrating the top and bottom supporting plates made in one piece.

Referring to FIG. 8, the first lateral panels 222 of the top supporting plate 22 of the skeleton 20 and the second lateral panels 232 of the bottom supporting plate 23 of the skeleton 20 can be made in one piece so that the top supporting plate 22 and the bottom supporting plate 23 are combined into a rectangular open frame. In the present preferred embodiment, the top supporting plate 22 and the bottom supporting plate 23 can be solid plastic plate members, or hollow plastic members with honeycomb holes defined therein.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lightweight cloth cover suitcase, comprising:

a cloth cover made by fastening multiple pieces of fabric sheets with stitches, said cloth cover comprising a rectangular body and a cover flap having four sides, said rectangular body having a rectangular opening in a front side thereof, said cover flap having one side thereof fixedly connected to one lateral side of said rectangular opening of said rectangular body and the other three sides thereof openably fastened to the other three sides of said rectangular opening with a zip fastener;

a skeleton mounted inside said rectangular body of said cloth cover to support said rectangular body in shape, said skeleton comprising a metal frame, said metal frame being a rectangular open frame made by bending a rectangular frame bar into shape and comprising a top frame bar portion, a bottom frame bar portion and two opposing side frame bar portions respectively connected between two opposite ends of said top frame bar portion and two opposite ends of said bottom frame bar portion, a top supporting plate comprising a top panel fixedly mounted at a top side of the top frame bar portion of said metal frame and two first lateral panels respectively downwardly curved from two opposite lateral sides of said top panel and respectively affixed to respective upper parts of the two opposing side frame bar portions of said metal frame at an outer side, a bottom supporting plate comprising a bottom panel fixedly mounted at a bottom side of the bottom frame bar portion of said metal frame and two second lateral panels respectively upwardly curved from two opposite lateral sides of said bottom panel and respectively affixed to respective lower parts of the two opposing side frame bar portions of said metal frame at an outer side, a slotted back panel affixed to a back side of said body and has a plurality of openings, and a honeycomb panel being a rectangular plastic hollow board having a plurality of honeycomb holes defined therein and fixedly mounted between a top surface of said bottom panel of said bottom supporting plate and a bottom surface of said bottom frame bar portion;

a plurality of wheel modules mounted at a bottom side of said cloth cover, each said wheel module comprising a mounting frame fixedly fastened to said bottom supporting plate and said honeycomb panel;

a retractable handle module comprising a top mounting frame fixedly mounted at a rear side of said top panel of said top supporting plate, a bottom mounting frame fixedly mounted at a rear side of said bottom panel of said bottom supporting plate, two vertical retractable bars having respective bottom ends thereof respectively affixed to said bottom mounting frame and respective opposing top ends thereof upwardly inserted through said top mounting frame and protruding over a top side of said top mounting frame, and a grip connected between the top ends of said two retractable bars; and four corner plates respectively mounted in respective first inner corners between said top panel and said first lateral panels of said top supporting plate and respective second inner corners between said bottom panel and said second lateral panel of said bottom supporting plate, wherein said slotted back panel is fixedly mounted at respective front surfaces of said corner plates that face toward the metal frame.

2. The lightweight cloth cover suitcase as claimed in claim 1, wherein said top supporting plate and said bottom supporting plate are fixedly fastened to said metal frame with fastening members selected from the group consisting of rivets and screws.

3. The lightweight cloth cover suitcase as claimed in claim 1, wherein said corner plates are ethylene vinyl acetate (EVA) copolymer foam boards.

4. The lightweight cloth cover suitcase as claimed in claim 1, wherein said top supporting plate and said bottom supporting plate are polyethylene plates.

5. The lightweight cloth cover suitcase as claimed in claim 1, wherein said slotted back panel is a polyethylene plate.

6. The lightweight cloth cover suitcase as claimed in claim 1, wherein said mounting frame of each said wheel module comprises a wheel holder closely attached to a bottom surface of said body of said cloth cover, a packing plate closely attached to a top surface of said honeycomb panel, and a plurality of fastening members selected from the group consisting of rivets and screws and inserted through said packing plate, said honeycomb panel, said bottom panel of said bottom supporting plate, said wheel holder and the bottom side of said body to fasten the respective said wheel module, said bottom supporting plate and said honeycomb panel together.

7. The lightweight cloth cover suitcase as claimed in claim 1, wherein said body of said cloth cover comprises a rear tubular wire affixed to and extended around the border of a back side thereof, and a front tubular wire affixed to and extended around the border of a front surface of said cover flap.

8. The lightweight cloth cover suitcase as claimed in claim 1, wherein said first lateral panels of said top supporting plate and said second lateral panels of said bottom supporting plate are made in one piece so that said top supporting plate and said bottom supporting plate are combined into a rectangular open frame.

9. The lightweight cloth cover suitcase as claimed in claim 8, wherein said top supporting plate and said bottom supporting plate are selectively solid plastic plate members, or hollow plastic members with honeycomb holes defined therein.

* * * * *